US008475111B2

(12) United States Patent
Stagg et al.

(10) Patent No.: US 8,475,111 B2
(45) Date of Patent: Jul. 2, 2013

(54) RING FAN AND SHROUD AIR GUIDE SYSTEM

(75) Inventors: Jonathan Bradley Stagg, Bellevue, MI (US); James W. Bailey, Marshall, MI (US)

(73) Assignee: BorgWarner Inc., Auburn Hills, MI (US)

( * ) Notice: Subject to any disclaimer, the term of this patent is extended or adjusted under 35 U.S.C. 154(b) by 733 days.

(21) Appl. No.: 12/594,017

(22) PCT Filed: Apr. 5, 2008

(86) PCT No.: PCT/US2008/059515

§ 371 (c)(1),
(2), (4) Date: Sep. 30, 2009

(87) PCT Pub. No.: WO2008/124656

PCT Pub. Date: Oct. 16, 2008

(65) Prior Publication Data

US 2010/0111667 A1 May 6, 2010

Related U.S. Application Data

(60) Provisional application No. 60/910,271, filed on Apr. 5, 2007.

(51) Int. Cl.
*F04D 29/54* (2006.01)
*F01P 5/06* (2006.01)

(52) U.S. Cl.
USPC ..... 415/1; 415/58.5; 415/57.3; 415/57.4

(58) Field of Classification Search
USPC ..... 415/54.1, 57.1, 57.3, 57.4, 58.5, 415/58.6, 58.7, 173.1, 173.6, 208.3, 220, 415/222, 1; 416/189
See application file for complete search history.

(56) References Cited

U.S. PATENT DOCUMENTS

| | | | | |
|---|---|---|---|---|
| 4,357,914 | A | 11/1982 | Hauser | |
| 4,566,852 | A * | 1/1986 | Hauser | 415/220 |
| 5,282,718 | A * | 2/1994 | Koff et al. | 415/57.3 |
| 5,489,186 | A * | 2/1996 | Yapp et al. | 415/58.7 |
| 5,762,034 | A * | 6/1998 | Foss | 123/41.49 |
| D446,295 | S | 8/2001 | Williams et al. | |
| 6,375,427 | B1 | 4/2002 | Williams et al. | |
| 6,599,088 | B2 | 7/2003 | Stagg | |
| 6,827,547 | B2 | 12/2004 | Robb | |
| 7,789,622 | B2 * | 9/2010 | Acre | 415/209.3 |

FOREIGN PATENT DOCUMENTS

| | | |
|---|---|---|
| JP | 63-26798 | 2/1988 |
| JP | 2004-316448 | 11/2004 |
| WO | WO 98/45601 | 10/1998 |

* cited by examiner

*Primary Examiner* — Edward Look
*Assistant Examiner* — Jesse Prager

(57) ABSTRACT

A ring fan and shroud guide system which includes a rotating fan member with a conical outer ring and a cylindrical shroud member overlapping at least a portion of the outer ring. A plurality of guide vanes are provided in the shroud which minimize the tangential velocity component of the air flow entering the tip-gap region and provide improved air flow through the system. The guide vanes can have a curved configuration.

29 Claims, 5 Drawing Sheets

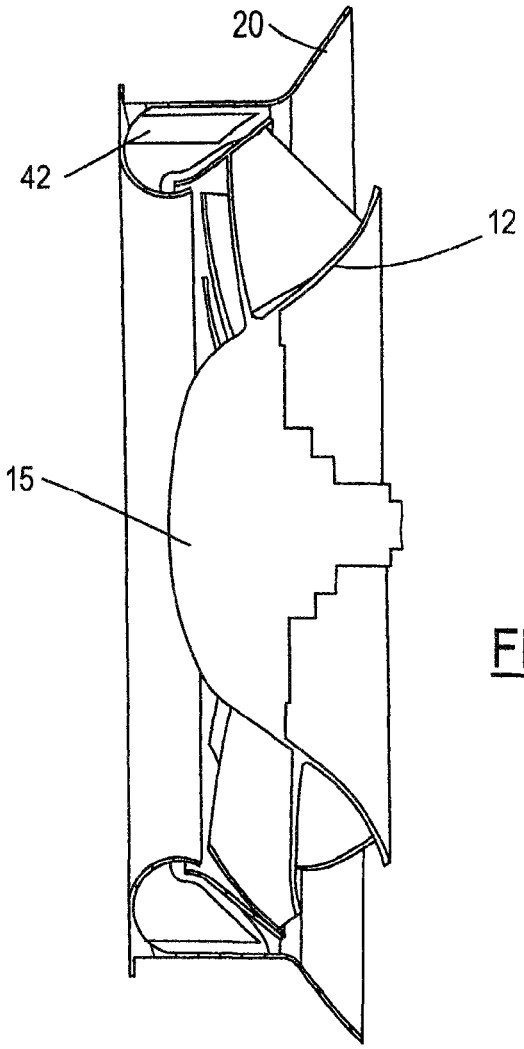
FIG. 5
FIG. 8
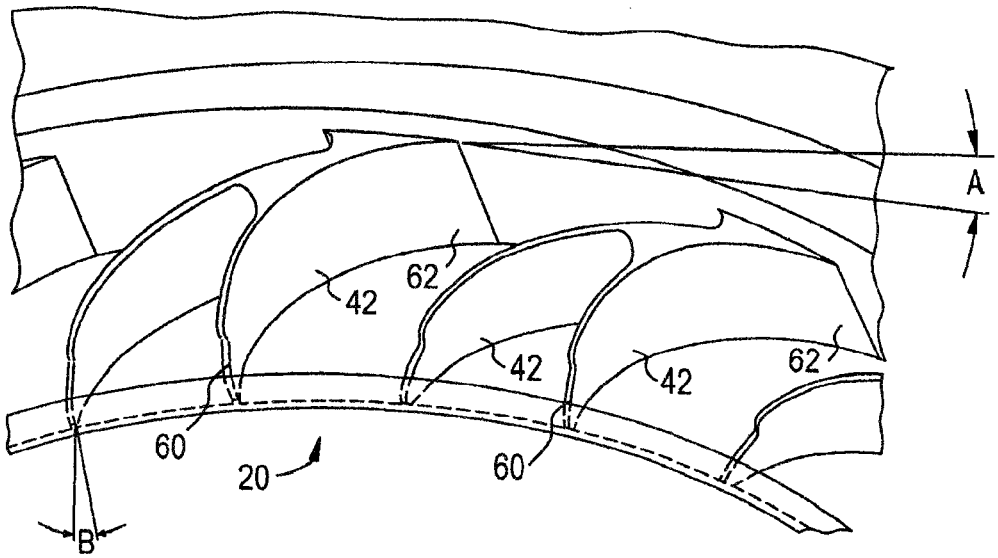

RING FAN AND SHROUD AIR GUIDE SYSTEM

TECHNICAL FIELD

The present invention relates generally to a ring fan and shroud assembly and more particularly to a ring fan and shroud assembly with improved air flow characteristics.

BACKGROUND OF THE INVENTION

Axial type fans move air, or other fluids, using rotating impeller blades. As the impeller blades rotate, different pressures on opposite sides of the blades are developed. The discharge sides of the impeller blades typically develop a high pressure while the intake sides develop a low pressure. The pressure differential between these two sides causes the fluid to flow from the high-pressure discharge side to the low-pressure intake side near the tips of the impeller blades creating an undesirable back flow of some of the fluid flow passing through the fan. It is well-known that this backflow can decrease the efficiency of the fan and may lead to undesirable noise generation.

Engine cooling fans develop static pressure across the fan such that the regions ahead of the fan are at significantly lower pressure than regions behind the fan. Many engine cooling fans have cowlings or shrouds positioned circumferentially around them in order to assist in directing the air flow in the desired direction. Practical operation of fans used in motor vehicle cooling systems dictate minimum clearances between the rotating fan members and stationary shroud members in order to ensure safe, durable functioning throughout the life of the vehicle.

Many of the cooling fan members used in such systems are ring-type fans, i.e. the fans have a circumferential ring member positioned on the tips of the fan blades. The pressures developed across the cooling fans drive leakage flow through the gaps occurring between the fan's blade tips or any rotating ring, and the stationary surfaces of the shroud.

In ring fans, the leakage flow encounters the tip gap at the trailing edge of the rotating ring and enters the gap region having a very high tangential velocity component. As the leakage flow progresses through the gap region, the viscous drag of the rotating ring continues to strengthen this vortical flow until finally it reaches the exit of the gap region, which is just upstream of the tips of the blades of the fan.

When the recirculating leakage flow reenters the main fan air flow passage, it possesses a very high tangential component, which is at odds with the velocity and direction of the primary incoming air flow of the fan. As the tangentially-oriented recirculating flow mixes with the passage of the primary air flow which is mostly axial, a vortex is formed adjacent the front of the leading edge at the tips of the fan blades. Since the leading edges of fan blades are designed for the primary flow velocity condition, the vortex encountered by the blades is misaligned relative to the intended inlet vector. This can cause the tip region to stall and the resulting low relative-momentum flow can "hang up" in the region of the blade tips and fan ring. This reduces the air flow rate of the fan, as well as its static pressure, and also increases the drag.

It would therefore be desirable to have a ring fan and shroud assembly that was effective in reducing these complications. It would further be desirable to minimize or eliminate the tangential velocity component prior to reinducing the leakage flow back into the primary air stream flowing through the fan. It would further be desirable to minimize the tip gap leakage flow and prevent tip stall.

SUMMARY OF THE INVENTION

It is, therefore, an object of the present invention to provide a ring fan and shroud assembly which minimizes the tip gap leakage flow and prevents tip stall. It is a further object of the present invention to provide a ring fan and shroud assembly with improved efficiency and reduced noise generation.

It is an additional object of the present invention to provide a ring fan and shroud assembly in which the shroud and guide vanes can be easily formed in a conventional two-piece mold injection molding process In accordance with the objects of the present invention, a ring fan and shroud guide assembly is provided. The fan assembly includes a plurality of impeller blades positioned within and attached to a conical outer ring. A portion of the stationary shroud member can overlap radially inwardly a portion of the fan's rotating ring. The shroud member and ring member form an annular recirculation nozzle adjacent the primary inlet air flow passage of the fan. A plurality of curved guide vanes are provided in the shroud member which act on the back flow of air entering the tip gap. The axially extending guide vanes have a substantially tangential leading edge orientation which align with the air flow entering the air gap. The curved guide vanes minimize or eliminate the tangential velocity component of the back flow air stream prior to reinducing that leakage flow back into the air stream through the recirculation nozzle.

The tip-gap has an entrance area substantially larger than the area of the recirculation nozzle. This, together with a converging exit region increases the velocity of the air flow injection of the leakage flow back into the fan's air stream.

Other features, benefits and advantages of the present invention will become apparent from the following description of the invention, when viewed in accordance with the attached drawings and appended claims.

BRIEF DESCRIPTION OF THE DRAWINGS

FIG. 5 is a cross-sectional view of the ring fan and shroud assembly as shown in FIG. 4, the cross-section being taken along lines 5-5 in FIG. 4.

FIGS. 8 and 9 illustrate an embodiment of the guide vanes in accordance with the present invention.

DESCRIPTION OF PREFERRED EMBODIMENTS

Figure 1:
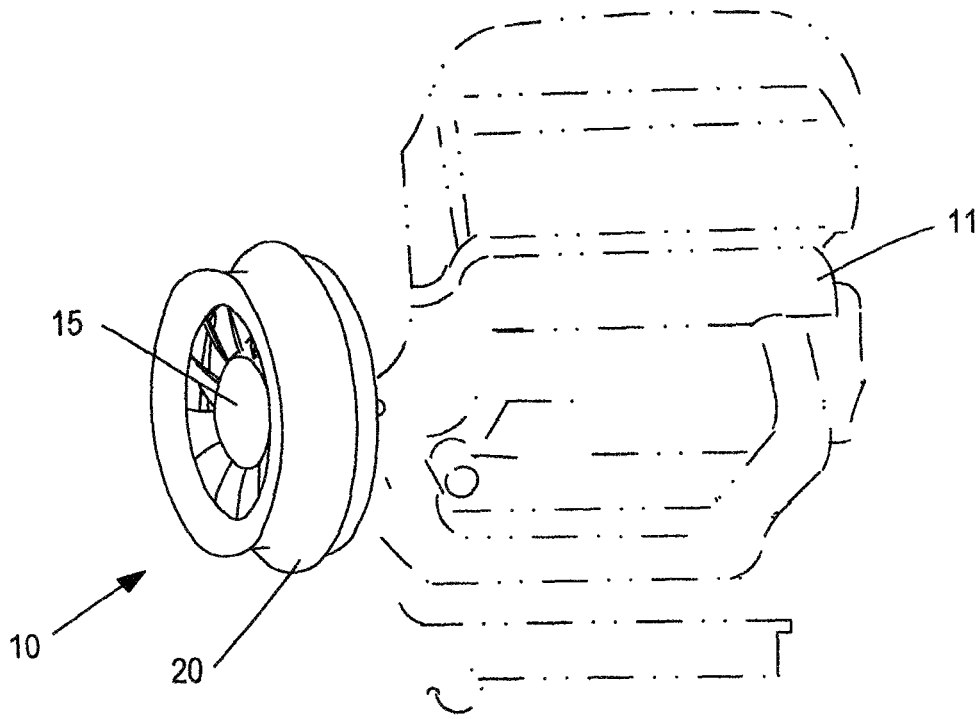
FIG. 1 is a schematic view of a vehicle engine having a cooling system according to a preferred embodiment of the present invention.
Figure 2:
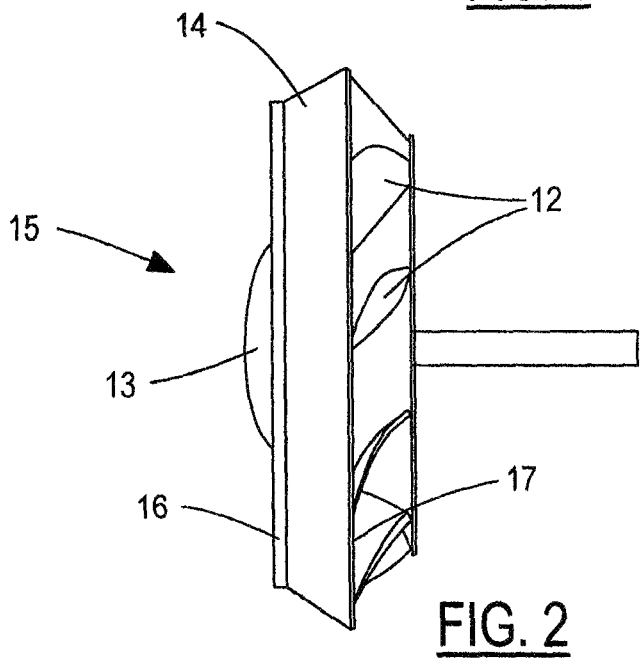
FIG. 2 illustrates a fan assembly in accordance with a preferred embodiment of the present invention.
Figure 3:
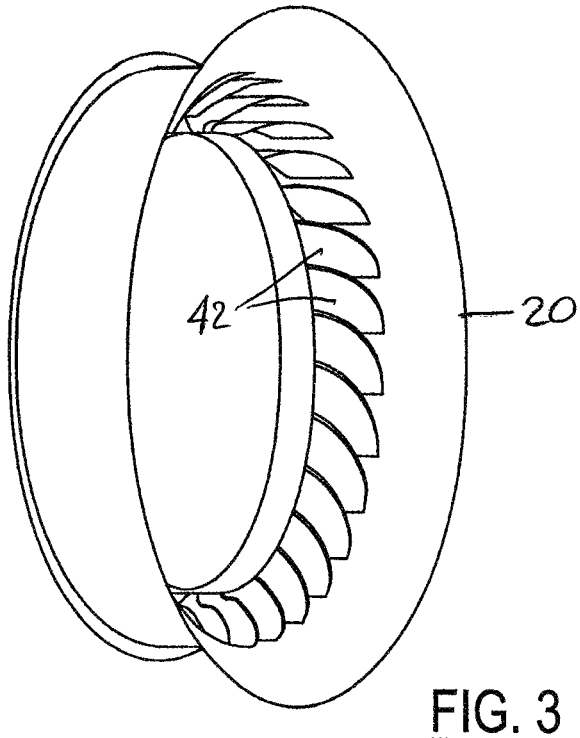
FIG. 3 illustrates a shroud member in accordance with a preferred embodiment of the present invention.
Figure 4:
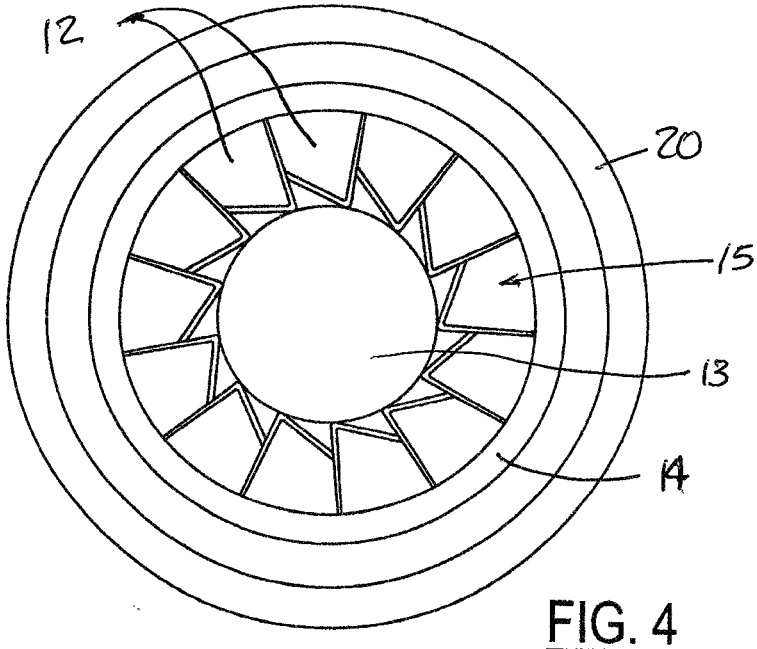
FIG. 4 shows a ring fan and shroud assembly in accordance with a preferred embodiment of the present invention.
Figure 6:
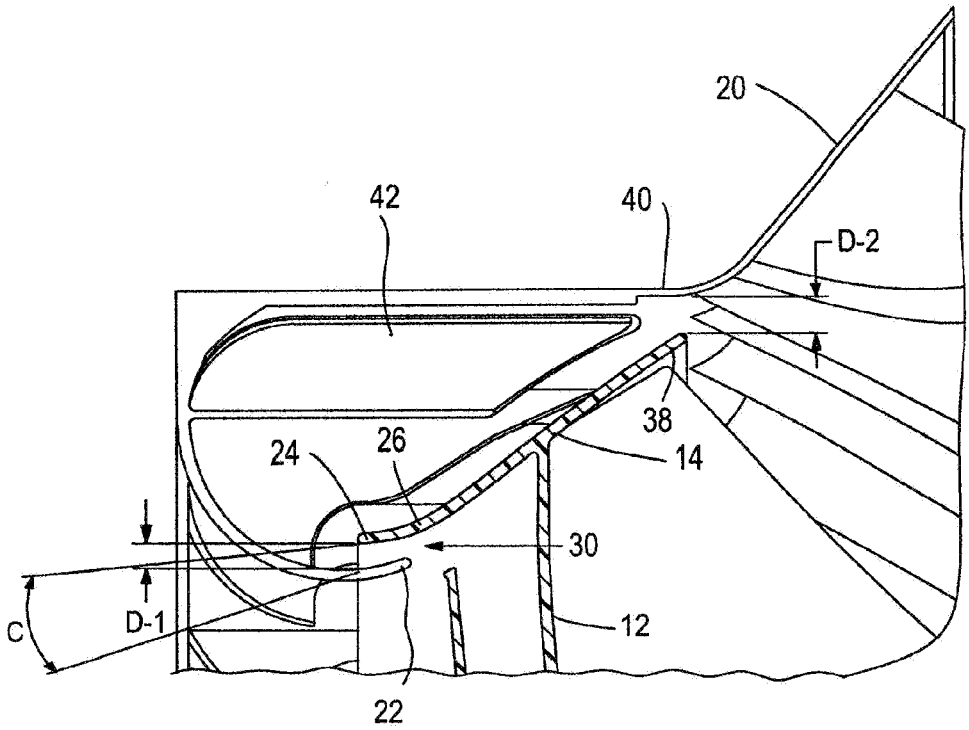
FIG. 6 is an enlarged view of a portion of the ring fan and shroud assembly cross-section as shown in FIG. 5.

FIG. 1 illustrates a ring fan and shroud guide system 10 in accordance with the present invention. Although it is contemplated that the ring fan and shroud guide assembly 10 can be used in a variety of applications, the system 10 in one preferred embodiment is intended for use in a cooling system for an engine 11. Specifically, the preferred embodiment of the present invention is intended for use in conjunction with a radiator cooling system in a truck or large vehicle. It is to be understood, however, that the present invention can be used in many applications, and the invention is not to be limited only to trucks or other vehicles.

The fan member 15 has a central hub member 13 and a plurality of blade members 12 (also called "impeller" members). A circumferential ring member 14 is positioned at and connected to the ends (or tips) of the blade members. The use of impeller blades and a rotating ring element to form a fan assembly is well known in the art, and these fan assemblies are commonly referred to as ring fans.

Also, although in the preferred embodiments, the ring fan is a solid complete annular ring member and is positioned at the tips of the blades, it is also possible that the ring member can be discontinuous with gaps between the blades or have openings in the ring itself, or that the ring member (or discontinuous portions thereof) can be positioned radially inwardly slightly from the ends of the blades.

The ring member 14 is preferably intricately formed with the fan assembly and thus fixedly attached to the tips of the fan blades. In accordance with a preferred embodiment of the present invention, the ring member also has a conical shape, as shown in the drawings. The outer ring has a smaller diameter at the air inlet or low pressure side 16 of the fan assembly and a larger diameter at the air discharge side, or high pressure side 17 of the rotating fan member.

The shroud member 20 is cylindrical in shape and is positioned circumferentially around, or substantially circumferentially around, all or a principal portion of the rotating ring fan member. The shroud member also has a portion or component 22 which is positioned radially inwardly of the leading edge 24 of the ring member and axially overlaps a corresponding portion 26 of the ring member. The portion 26 is spaced a radial distance D-1 from the ring member and forms a nozzle 30 with an annular cross-sectional area. This nozzle 30 is called the recirculation nozzle as it reinjects into the primary fan air stream 32 the back flow of air 34 which enters into the tip gap 36.

The trailing edge 38 of the ring member and a second portion or surface 40 of the shroud member are spaced apart a certain radial distance D-2. This is called the tip gap 36—or tip gap region—and is the area where a portion of the air flow (see arrows 34 in FIG. 7) flows back in the opposite direction of the main air flow of the fan 15. The tip gap region also has an annular cross-sectional area.

The distance D-2 is larger than the distance D-1, and similarly the annular cross-sectional area of the tip gap region 36 is larger than the annular cross-sectional area of the recirculation nozzle 30. Preferably, the distance D-2 is substantially larger than distance D-1, by 50% or more.

A plurality of guide vanes 42 are provided in the shroud member 20. The space inbetween the vane members may be varied to modify frequency of pressure pulses relative to a point on the fan as it proceeds through a full revolution in an effort to reduce fan noise and vibration (NVH). The number of vanes—as well as the number of fan blades—also preferably correspond with a prime numbering system in order to help reduce NVH. In this regard, one possible ring fan and shroud assembly can have thirteen fan blade members and thirty-one guide vane members.

Figure 7:
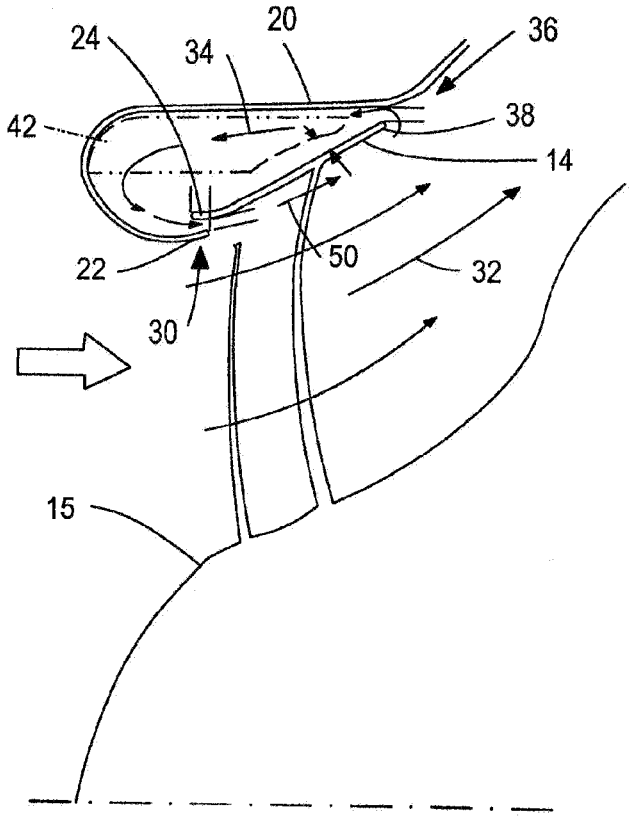
FIG. 7 is an illustration similar to FIG. 6 and showing the components and air flows in a schematic manner.

As indicated, in accordance with the present invention, the shroud member forms a recirculation nozzle which defines a flow passage adjacent to the primary incoming flow stream. The larger entrance area of the tip-gap region in conjunction with a converging exit region of the area of the recirculation nozzle effectively provides high velocity injection of the leakage air flow back into the fan air stream. This also minimizes the tip-gap leakage flow. The tip-gap leakage flow 50 and the upstream primary flow 32 are merged together and align with each other as shown in FIG. 7. This is in proper incidence with respect to the leading edge angle of the tip of the fan blade near the ring.

Also, the high velocity leakage flow that reenters the fan's tip air stream through the reduced area in the nozzle utilizes the Coanda effect to stay attached to the rotating ring member. This helps to energize the low relative momentum flow existing in the blade tip/rotating ring region and prevents tip stall.

The guide vanes 42 preferably have a curved configuration. As shown in FIG. 8, the vanes also have substantially tangential leading edges 62 which initially direct and orientates the air flow entering the tip-gap region, and have substantially radial trailing edges 60 adjacent the recirculation nozzles. The guide vanes minimize or eliminate the tangential velocity component of the air flow as it passes through the shroud chambers—and prior to reinducing the leakage flow back into the air stream flowing into the fan.

It is also possible for the shroud to have guide vanes which have different configurations, so long as some are curved and the pattern of various types and configurations is uniformly spaced around the circumference of the shroud for balance. The amount of curvature of the guide vanes could even differ around the perimeter of the shroud.

The guide vanes on the shroud member smoothly "capture" the leakage flow as it enters the tip gap region. This is aided by the substantial tangential leading edge of the vanes, along with the substantially radial trailing edge. This gently turns the flow direction from tangential to radial and axial. A meridional air flow is created as the vanes effectively remove the tangential component from the recirculation flow. A meridional air flow is one having only radial and axial velocity components without a tangential component present.

The reinjection of the recirculation flow at high velocity energizes the low relative momentum fluid and utilizes the Coanda effect to help keep the primary flow attached to the surface of the rotating ring. The Coanda effect is a well-known aerodynamic effect discovered in 1930 by Henri-Marie Coanda. Coanda observed that a stream of air emerging from a nozzle tends to follow a nearby surface as long as the curvature or angle of the surface does not vary sharply from the flow direction. The present invention uses this effect since the flow emerging from the recirculation nozzle is directed along the inner surface of the rotating ring, helping to prevent tip stall. Additionally, in one embodiment, air flows past the discharge surface and along the shroud exit surface without recirculating back through the tip gap.

In one embodiment, the shroud exit element is substantially parallel and coincident with the trailing edge of the rotating ring. The decrease in flow area between the tip gap region entrance and exit, and the converging nature of the nozzle promote acceleration of the flow as it reenters the fan passage. This promotes a significant pressure drop across the nozzle which in turn improves the capacity of the fan to sustain high static pressure differential across the fan.

Figure 9:
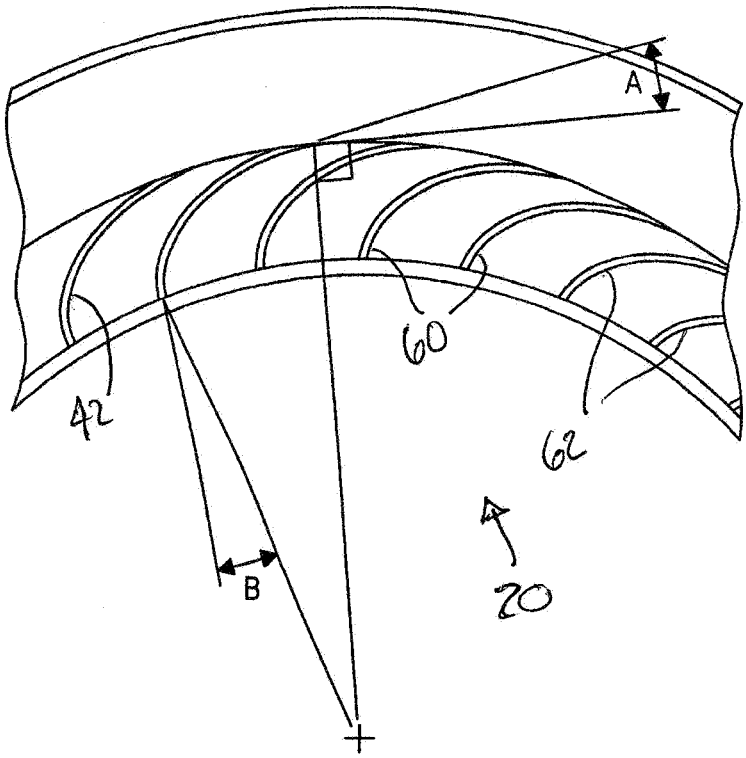

In a preferred embodiment of the present invention, the shroud guide vane members are characterized by the following features: the tip-gap D-2 ranges from ¼ inch to 1 inch, the inlet angle A ranges from 0 to 20 degrees, and the exit angle B ranges from −20 degrees to +20 degrees. See FIGS. 8-9.

In addition, the recirculation nozzle 30 formed by the present invention can be characterized by the following features in accordance with a preferred embodiment: The nozzle gap D-1 ranges from ⅛ inch to ½ inch, the overlap 24 of the shroud at the nozzle ranges from 0.1 to 1 inch, and the nozzle angle C of the nozzle exit edge ranges from 0 to 20 degrees.

With the present invention, a significantly improved pressure rise is achieved, together with stability and static efficiency. In general, the low relative momentum fluid trapped under the inside of the ring member at the blade tips is energized and the recirculation flow is reinjected back into the flow passage with the swirl removed. This helps to move the flow through the blade tip region and ensure that the recirculating flow encounters the leading edges of the blades aligned with the inlet angle of the blades.

The ring fan and shroud guide system in accordance with the present invention can be manufactured using a two-piece injection molding tool. It is not necessary in accordance with the present invention to utilize expensively machined channels in the casing walls as apparently employed in some current compressor tip casing treatments.

While preferred embodiments of the present invention have been shown and described herein, numerous variations and alternative embodiments will occur to those skilled in the art. Accordingly, it is intended that the invention is not limited to the preferred embodiments described herein but instead limited to the terms of the appended claims.

What is claimed is:

1. A ring fan and shroud air guide system comprising:

a fan member having a hub and a plurality of blades extending outwardly from the hub;

a ring member attached to the blades, said ring member having a conical axially extending shape;

a shroud member positioned around said fan member and ring member, said shroud member having a portion axially overlapping and radially inward of a first portion of said ring member and forming a tip gap with a second portion of said ring member; and said shroud member and said first portion of said ring member forming a recirculation nozzle;

a plurality of guide vanes positioned in said shroud member, said guide vanes having a curved configuration to minimize the tangential component of the recirculation air flow through said tip gap;

said guide vanes having a leading edge and a trailing edge, said leading edge positioned axially overlapping a first portion of said ring member.

2. A ring fan and shroud air guide system as described in claim 1 wherein said tip gap is greater in cross-sectional area than said recirculation nozzle, and wherein air flow passing through said tip gap increases in velocity when it is injected back into the air stream of the fan through said recirculation nozzle.

3. A ring fan and shroud air guide system comprising:

a rotating ring fan member having a hub member, a plurality of fan blade members and a ring member attached to the ends of the blades; and a stationary shroud member positioned substantially circumferentially around said ring fan member;

said shroud member and ring member having a tip gap therebetween, said tip gap having a first annular cross-sectional area and forming a first spaced distance therebetween;

said shroud member and ring member having a recirculation nozzle therebetween, said recirculation nozzle having a second annular cross-sectional area and forming a second spaced distance therebetween;

said shroud member having a plurality of curved guide vane members to direct air flow entering through said tip gap into and out through said nozzle member and back into the main air stream created by said rotating ring fan member;

said guide vanes having a leading edge and a trailing edge, said leading edge positioned axially overlapping a first portion of said ring member.

4. A ring fan and shroud air guide system as described in claim 3 wherein the number of guide vane members is greater than the number of fan blade members.

5. A ring fan and shroud air guide system as described in claim 4 wherein thirty-one guide vane members are provided and thirteen fan blade members are provided.

6. A ring fan and shroud air guide system as described in claim 3 wherein said guide vane members extend from a position adjacent said tip gap to a position adjacent said nozzle.

7. A ring fan and shroud air guide system as described in claim 3 wherein said ring member has a conical configuration.

8. A ring fan and shroud air guide system as described in claim 3 wherein said shroud member has a first portion axially overlapping and positioned radially inwardly of a first portion of said ring member.

9. A ring fan and shroud air guide system as described in claim 8 wherein said ring member has a conical configuration, said conical configuration increasing in a radial size in the same axial direction as the air flow of the rotating ring fan member.

10. A ring fan and shroud air guide system as described in claim 3 wherein said recirculation nozzle comprises a first portion of said shroud member axially overlapping and positioned radially inwardly of said ring member, and a corresponding first portion of said ring member.

11. A ring fan and shroud air guide system as described in claim 3 wherein said first annular cross-section of said tip gap is greater in area than said second annular cross-section of said recirculation nozzle.

12. A ring fan and shroud air guide system as described in claim 3 wherein said first spaced distance is greater than said second spaced distance.

13. A ring fan and shroud air guide system as described in claim 3 wherein each of said guide vanes has a curved configuration sufficient to substantially minimize the tangential component of the air flow entering through said tip gap.

14. A ring fan and shroud air guide system as described in claim 3 wherein a plurality of said guide vanes have a curved configuration sufficient to substantially minimize the tangential component of the air flow entering through said tip gap.

15. A method for improving the air flow of a ring fan and shroud air guide assembly, said method comprising:

providing a rotating ring fan member, said ring fan member having a central hub member, a plurality of radially projecting blade members, and a ring member positioned on or adjacent to the ends of the blade members;

providing a stationary shroud member positioned substantially circumferentially around said rotating ring fan member, said shroud member comprising a plurality of curved guide vane members;

said guide vanes having a leading edge and a trailing edge, said leading edge positioned axially overlapping a first portion of said ring member;

providing a recirculation nozzle between a first portion of said shroud member and a first portion of said ring member; and providing a tip gap region between a second portion of said shroud member and a second portion of said ring member; the size of said tip gap region being greater than the size of said nozzle member.

16. The method for improving the air flow of a ring fan and shroud air guide assembly as described in claim 15 wherein said ring member has an axially extending conical configuration.

17. The method for improving the air flow of a ring fan and shroud air guide assembly as described in claim 15 wherein the size of said tip gap region is greater in cross-sectional area and radially distance than the corresponding size of said recirculation nozzle.

18. A ring fan and shroud air guide system as described in claim 1 wherein said leading edge of said guide vanes has an orientation in a substantially tangential direction.

19. A ring fan and shroud air guide system as described in claim 18 wherein the orientation of said leading edge of said guide vanes is in the range of about 0-20° to the tangential direction.

20. A ring fan and shroud air guide system as described in claim 1 wherein said trailing edge of said guide vanes have an orientation substantially in a radial direction to the flow of air entering the tip gap.

21. A ring fan and shroud air guide system as described in claim 20 wherein the orientation of said trailing edge of said guide vanes is in the range of −20° to +20° to the radial direction.

22. A ring fan and shroud air guide system as described in claim 3 wherein said leading edge of said guide vanes has an orientation in a substantially tangential direction.

23. A ring fan and shroud air guide system as described in claim 22 wherein the orientation of said leading edge of said guide vanes is in the range of about 0-20° to the tangential direction.

24. A ring fan and shroud air guide system as described in claim 3 wherein said trailing edge of said guide vanes have an orientation substantially in a radial direction to the flow of air entering the tip gap.

25. A ring fan and shroud air guide system as described in claim 24 wherein the orientation of said trailing edge of said guide vanes is in the range of −20° to +20° to the radial direction.

26. The method for improving the air flow of a ring fan and shroud air guide assembly as described in claim 15 wherein said leading edge of said guide vanes has an orientation in a substantially tangential direction.

27. The method for improving the air flow of a ring fan and shroud air guide assembly as described in claim 26 wherein the orientation of said leading edge of said guide vanes is in the range of about 0-20° to the tangential direction.

28. The method for improving the air flow of a ring fan and shroud air guide assembly as described in claim 15 wherein said trailing edge of said guide vanes have an orientation substantially in a radial direction to the flow of air entering the tip gap.

29. The method for improving the air flow of a ring fan and shroud air guide assembly as described in claim 28 wherein the orientation of said trailing edge of said guide vanes is in the range of −20° to +20° to the radial direction.

* * * * *